US007736187B2

(12) United States Patent
Yaworski et al.

(10) Patent No.: US 7,736,187 B2
(45) Date of Patent: Jun. 15, 2010

(54) ELECTRICAL CONNECTOR ASSEMBLIES AND JOINT ASSEMBLIES AND METHODS FOR USING THE SAME

(75) Inventors: Harry George Yaworski, Apex, NC (US); Kenton Archibald Blue, Fuquay-Varina, NC (US); Sherif I. Kamel, Cary, NC (US); Timothy J. McLaughlin, Fuquay-Varina, NC (US); Kenneth R. Gawason, Monroe, NJ (US)

(73) Assignee: Tyco Electronics Corporation, Middletown, PA (US)

( * ) Notice: Subject to any disclaimer, the term of this patent is extended or adjusted under 35 U.S.C. 154(b) by 161 days.

(21) Appl. No.: 11/823,951

(22) Filed: Jun. 29, 2007

(65) Prior Publication Data

US 2008/0233785 A1 Sep. 25, 2008

Related U.S. Application Data

(60) Provisional application No. 60/918,981, filed on Mar. 20, 2007.

(51) Int. Cl.
*H01R 13/68* (2006.01)

(52) U.S. Cl. ..... 439/620.26

(58) Field of Classification Search ..... 439/521, 439/276, 186, 620.26, 588, 801, 755
See application file for complete search history.

(56) References Cited

U.S. PATENT DOCUMENTS

| | | | | |
|---|---|---|---|---|
| 2,311,758 A | | 2/1943 | Johansson | |
| 2,836,682 A | * | 5/1958 | Matthysse | 337/189 |
| 3,020,260 A | | 2/1962 | Nelson | |
| 3,699,497 A | * | 10/1972 | Cooper et al. | 439/588 |
| 4,369,284 A | | 1/1983 | Chen | |
| 4,425,017 A | | 1/1984 | Chan | |
| 4,595,635 A | | 6/1986 | Dubrow et al. | |
| 4,600,261 A | | 7/1986 | Debbaut | |

(Continued)

FOREIGN PATENT DOCUMENTS

DE 34 28 258 A1 2/1986

(Continued)

OTHER PUBLICATIONS

Invitation to Pay Additional Fees and, Where Applicable, Protest Fee (8 pages) corresponding to International Application No. PCT/US2008/003127; Mailing Date: Oct. 9, 2008.

(Continued)

*Primary Examiner*—Edwin A. Leon
(74) *Attorney, Agent, or Firm*—Myers Bigel Sibley & Sajovec, PA

(57) ABSTRACT

An electrical joint assembly for connecting a plurality of conductors includes a busbar hub and a plurality of limiter modules. The busbar hub includes an electrically conductive busbar body and a plurality of conductor legs extending from the busbar body. The limiter modules each include a fuse element. Each of the limiter modules is connected to a respective one of the conductor legs and is connectable to a respective conductor to provide a fuse controlled connection between the respective conductor leg and the respective conductor. Each of the limiter modules is independently removable from the respective one of the conductor legs.

28 Claims, 11 Drawing Sheets

U.S. PATENT DOCUMENTS

| | | | | |
|---|---|---|---|---|
| 4,634,207 | A | 1/1987 | Debbaut | |
| 4,680,233 | A | 7/1987 | Camin et al. | |
| 4,701,574 | A | 10/1987 | Shimirak et al. | |
| 4,716,183 | A | 12/1987 | Gamarra et al. | |
| 4,721,832 | A | 1/1988 | Toy | |
| 4,777,063 | A | 10/1988 | Dubrow et al. | |
| 4,852,646 | A | 8/1989 | Dittmer et al. | |
| 4,880,676 | A | 11/1989 | Puigcerver et al. | |
| 4,888,070 | A | 12/1989 | Clark et al. | |
| 4,942,270 | A | 7/1990 | Gamarra | |
| 4,963,700 | A | 10/1990 | Olsen et al. | |
| 5,023,402 | A | 6/1991 | King, Jr. et al. | |
| 5,079,300 | A | 1/1992 | Dubrow et al. | |
| 5,099,088 | A | 3/1992 | Usami et al. | |
| 5,140,476 | A | 8/1992 | Kim | |
| 5,177,143 | A | 1/1993 | Chang et al. | |
| 5,357,057 | A | 10/1994 | Debbaut | |
| 5,529,508 | A | 6/1996 | Chiotis et al. | |
| 5,561,269 | A | 10/1996 | Robertson et al. | |
| 5,588,856 | A | 12/1996 | Collins et al. | |
| 5,626,190 | A | 5/1997 | Moore | |
| 5,648,749 | A | 7/1997 | Lin et al. | |
| 5,772,473 | A | 6/1998 | Cheng et al. | |
| 5,824,954 | A | 10/1998 | Biche et al. | |
| 5,828,005 | A | 10/1998 | Huynh-Ba et al. | |
| 5,848,913 | A | 12/1998 | Ashcraft | |
| 5,962,811 | A | 10/1999 | Rodrigues et al. | |
| 6,025,559 | A | 2/2000 | Simmons | |
| 6,227,908 | B1 * | 5/2001 | Aumeier et al. | 439/607.01 |
| 6,730,847 | B1 | 5/2004 | Fitzgerald et al. | |
| 6,854,996 | B2 * | 2/2005 | Yaworski et al. | 439/276 |
| 7,037,128 | B2 | 5/2006 | Yaworski et al. | |
| 7,056,151 | B2 | 6/2006 | Cawood et al. | |
| 7,160,146 | B2 | 1/2007 | Cawood et al. | |
| 7,172,462 | B1 * | 2/2007 | Gronowicz, Jr. | 439/620.26 |
| 2002/0102874 | A1 | 8/2002 | Hobson et al. | |
| 2004/0161968 | A1 | 8/2004 | Cawood et al. | |

FOREIGN PATENT DOCUMENTS

| | | | |
|---|---|---|---|
| DE | 90 04 669 | U1 | 6/1990 |
| EP | 0 108 518 | B1 | 5/1984 |
| EP | 0 203 737 | A2 | 12/1986 |
| EP | 0 328 386 | A2 | 8/1989 |
| WO | WO 88/00603 | A2 | 1/1988 |
| WO | WO 90/05401 | A1 | 5/1990 |
| WO | WO 95/15600 | A1 | 6/1995 |
| WO | WO 95/24756 | A1 | 9/1995 |
| WO | WO 96/23007 | A1 | 8/1996 |
| WO | WO 97/42693 | A1 | 11/1997 |
| WO | WO 2004/075358 | A1 | 9/2004 |

OTHER PUBLICATIONS

Behnke et al., "The Secondary Network Distribution Systems Background and Issues Related to the Interconnection of Distributed Resources," National Renewable Energy Laboratory, 35 pages, Jul. 2005.

Research and Development Project, "Development of a Fusible Crab with Indication of Blown Limiter," 11 pages, Jan. 2006.

Homac Mfg. Company, Fact Sheet, "*Flood-Seal"® Rubberized Aluminum Bar*.

Connector Mfg. Company, Fact Sheet, *Submersible Secondary Connectors*, Jun. 2001, p. B-1.

* cited by examiner

ELECTRICAL CONNECTOR ASSEMBLIES AND JOINT ASSEMBLIES AND METHODS FOR USING THE SAME

RELATED APPLICATION(S)

The present application claims the benefit of priority from U.S. Provisional Patent Application Ser. No. 60/918,981, filed Mar. 20, 2007, the disclosure of which is incorporated herein by reference in its entirety.

FIELD OF THE INVENTION

The present invention relates to electrical connector assemblies and methods for using the same and, more particularly, to environmentally protected electrical connector assemblies and methods for forming environmentally protected connections.

BACKGROUND OF THE INVENTION

Electrical junction joint assemblies such as a "crab joints" are used in low voltage secondary power distribution networks. A crab joint basically includes a central hub (referred to as the "busbar") with multiple fusible connections (referred to as "limiters") to a number of cables constituting part of the network. The limiters act to protect the cables connected to them in case of failure of any of the cables in the network.

The conventional crab joint used by some electrical utilities uses compression connectors with EPDM rubber seals to connect network cables to the busbar. The limiter elements cannot be individually replaced. In the conventional-crab joint design, a failed or blown limiter is not readily discernable from the exterior of the crab joint. This makes it very hard for a casual observer to detect an opened limiter in a crab joint. These conditions may go undetected for a long time. When and if customers complain about low voltage in the area or overloading of a network transformer, troubleshooting crews are deployed to look for blown limiters and for open secondary mains in the area. However, each limiter must be tested in a chosen manhole. Troubleshooting blown limiters takes time and it may be crucial to restore customers' service or to mitigate the overload as soon as possible. It has been suggested by others to provide a crab joint that provides a visual indication when a limiter thereof has blown.

Power distribution connections as discussed above are typically housed in an above-ground cabinet or a below-grade box. The connections may be subjected to moisture and may even become submerged in water. If the cable conductors or conductor members of the busbars are left exposed, water and environmental contaminants may cause short circuit failure and/or corrosion thereon. The conductor members of the busbars are sometimes formed of aluminum, so that water may cause oxidation of the conductor members. Such oxidation may be significantly accelerated by the relatively high voltages employed (typically 120 volts to 1000 volts).

SUMMARY OF THE INVENTION

According to embodiments of the present invention, an electrical joint assembly for connecting a plurality of conductors includes a busbar hub and a plurality of limiter modules. The busbar hub includes an electrically conductive busbar body and a plurality of conductor legs extending from the busbar body. The limiter modules each include a fuse element. Each of the limiter modules is connected to a respective one of the conductor legs and is connectable to a respective conductor to provide a fuse controlled connection between the respective conductor leg and the respective conductor. Each of the limiter modules is independently removable from the respective one of the conductor legs.

According to some embodiments of the present invention, a limiter module for electrically connecting at least one conductor includes a housing, a fuse element and sealant. The housing defines a port including a conductor passage configured to receive a conductor therethrough. The fuse element is disposed in the housing and is connectable to the conductor inserted through the conductor passage. The sealant is disposed in the conductor passage of the port. The sealant is adapted for insertion of the conductor therethrough such that the sealant provides an environmental seal about the conductor.

According to embodiments of the present invention, a limiter module for electrically connecting at least one conductor includes a fuse element, an electrically conductive connector member configured to engage and form an electrical connection with the at least one conductor to electrically couple the at least one conductor with the fuse element, and at least one shear bolt to controllably secure the at least one conductor to the connector member.

According to some embodiments of the present invention, a connector assembly for electrically connecting a plurality of conductors includes a housing defining a port including a conductor passage configured to receive a conductor therethrough. Sealant is disposed in the conductor passage of the port. The sealant is adapted for insertion of the conductor therethrough such that the sealant provides an environmental seal about the conductor. An electrically conductive connector member is disposed in the housing. The connector assembly further includes at least one shear bolt to controllably secure the conductor to the connector member.

According to embodiments of the present invention, an in-line splice connector module for electrically connecting first and second conductors includes a housing and sealant. The housing defines first and second ports each including a conductor passage configured to receive the first and second conductors, respectively, therethrough. The sealant is disposed in the conductor passages of each of the first and second ports. The sealant is adapted for insertion of the first and second conductors therethrough such that the sealant provides an environmental seal about the first and second conductors. The in-line splice connector module is configured to receive and maintain the first and second conductors along substantially the same axis.

According to method embodiments of the present invention, a method for providing a fuse controlled electrical connection between conductors includes electrically connecting first and second conductors using a limiter module, the limiter module including an electrically insulating housing and a fuse element disposed in the housing. The first and second conductors form a part of a secondary power distribution network. The limiter module includes a visual indicator device to selectively indicate a status of the fuse element to an operator. The visual indicator device includes a translucent or transparent viewing window in the housing.

According to embodiments of the present invention, a busbar hub assembly includes an electrically conductive busbar body and a cover assembly surrounding and electrically insulating the busbar body. The cover assembly includes a cover portion and an abrasion resistant outer layer. The cover portion is formed of an electrically insulating first material. The abrasion resistant outer layer is formed of a second material having a greater abrasion resistance than the first material.

Further features, advantages and details of the present invention will be appreciated by those of ordinary skill in the art from a reading of the figures and the detailed description of the preferred embodiments that follow, such description being merely illustrative of the present invention.

DETAILED DESCRIPTION OF THE EMBODIMENTS OF THE INVENTION

Figure 1:
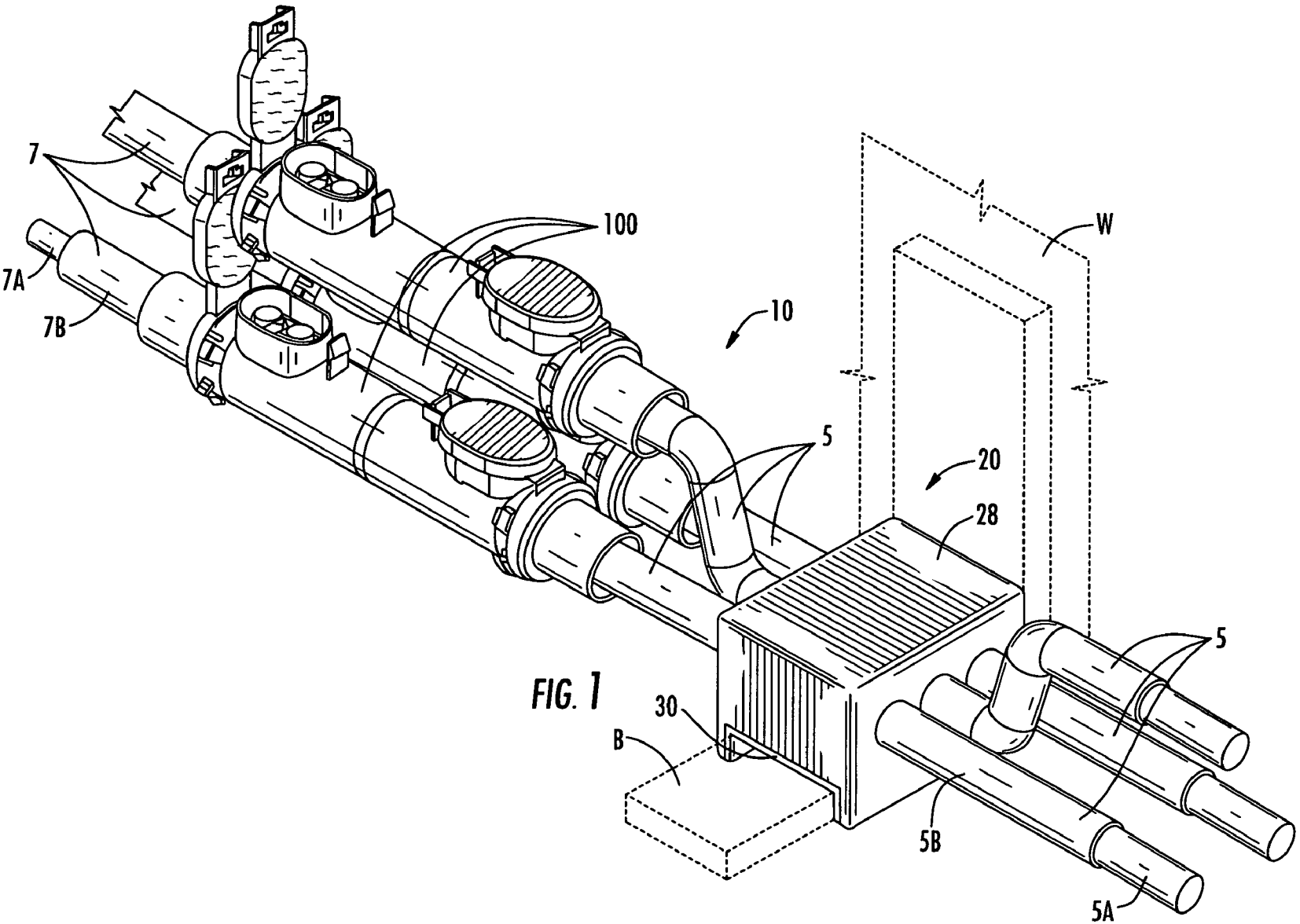
FIG. 1 is a perspective view of an electrical joint assembly according to embodiments of the present invention.

The present invention now will be described more fully hereinafter with reference to the accompanying drawings, in which illustrative embodiments of the invention are shown. In the drawings, the relative sizes of regions or features may be exaggerated for clarity. This invention may, however, be embodied in many different forms and should not be construed as limited to the embodiments set forth herein; rather, these embodiments are provided so that this disclosure will be thorough and complete, and will fully convey the scope of the invention to those skilled in the art.

It will be understood that when an element is referred to as being "coupled" or "connected" to another element, it can be directly coupled or connected to the other element or intervening elements may also be present. In contrast, when an element is referred to as being "directly coupled" or "directly connected" to another element, there are no intervening elements present. Like numbers refer to like elements throughout. As used herein the term "and/or" includes any and all combinations of one or more of the associated listed items.

In addition, spatially relative terms, such as "under", "below", "lower", "over", "upper" and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "under" or "beneath" other elements or features would then be oriented "over" the other elements or features. Thus, the exemplary term "under" can encompass both an orientation of over and under. The device may be otherwise oriented (rotated 90 degrees or at other orientations) and the spatially relative descriptors used herein interpreted accordingly.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof. As used herein the expression "and/or" includes any and all combinations of one or more of the associated listed items.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

As used herein, "secondary network distribution system" or "secondary power distribution network" means: An AC power distribution system in which customers are served from three-phase, four-wire low-voltage circuits supplied by two or more network transformers whose low-voltage terminals are connected to the low-voltage circuits through network protectors. The secondary network system has two or more high-voltage primary feeders, with each primary feeder typically supplying 1-30 network transformers, depending on network size and design. The system includes automatic protective devices intended to isolate faulted primary feeders, network transformers, or low-voltage cable sections while maintaining service to the customers served from the low-voltage circuits.

With reference to FIGS. 1-8, a joint assembly 10 according to embodiments of the present invention is shown therein. The joint assembly 10 includes a busbar hub 20 and a plurality of limiter assemblies or modules 100 according to embodiments of the present invention. The busbar hub 20 includes a plurality of conductor legs or conductor cables 5 (each including a conductor 5A and an insulation cover 5B). The joint assembly 10 may be used to electrically connect a plurality of conductor cables 7 (each including a conductor 7A and an insulation cover 7B) to one another. Each of the cables 7 may be connected or terminated to a respective cable 5 via a respective one of the limiter modules 100 to provide a fuse controlled or protected interface with the busbar hub 20. According to some embodiments (such as the embodiment illustrated in FIGS. 1, 2 and 8), the joint assembly 10 is configured as a crab joint. According to some embodiments, each limiter module 100 is removable and replaceable on the cables 5, 7.

Each limiter module 100 may provide an environmentally protected and, according to some embodiments, watertight, connection between the conductors of the respective cables 5, 7. For example, the joint assembly 10 may be used to electrically connect the conductors of a power feed cable and one or more branch or tap cables, while preventing the conductive portions of the cables 5, 7 and the joint assembly 10 from being exposed to surrounding moisture or the like. According to some embodiments, each limiter module 100 can be cold applied to form an instant environmental seal about the cables 5, 7.

Figure 2:
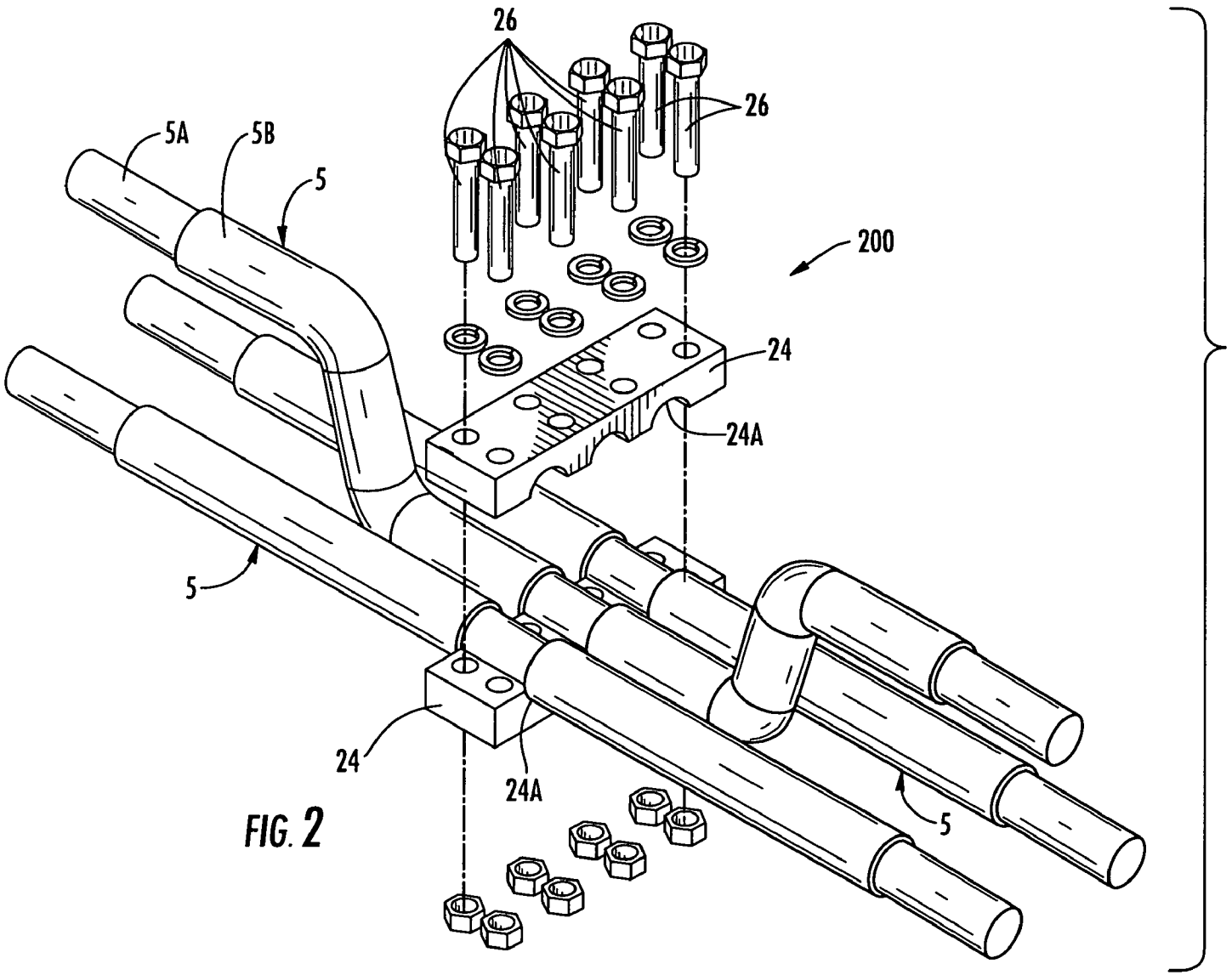
FIG. 2 is an exploded view of a busbar assembly forming a part of the electrical joint assembly of FIG. 1.

Turning to the busbar hub 20 in more detail and with reference to FIG. 2, the busbar hub 20 includes a pair of electrically conductive busbar members or plates 24, bolts 26, and a dielectric over-insulation cover 28 (FIG. 1). Grooves 24A are defined in the plates 24 to received bare conductor portions of the cables 5. The bolts 26 secure the plates 24 together in clamshell manner around the cables 5 to affix the cables therein. According to some embodiments, the cables 5 are flexible so that they may be bent or moved during installation of the limiter modules 100. According to other embodiments, the cables 5 may be rigid legs. According to some embodiments, one or more of the cables 5 may be pre-bent into a non-linear shape or configuration to provide spacing, flexibility and/or improved ease of installation for the limiter modules. For example, in FIG. 1, the middle cables 5 on either side of the busbar hub 20 are pre-bent into a generally S-shape while the outer cables 5 extend straight. The pre-bent cables 5 may be rigid cable legs or flexible cables.

A suitable bracket may be provided for mounting the busbar hub 20 on a rail, platform, or support bracket or fixture B on a wall W or other support surface. The bracket may be integrated with the overinsulation cover 28 (FIG. 1).

Figure 3:
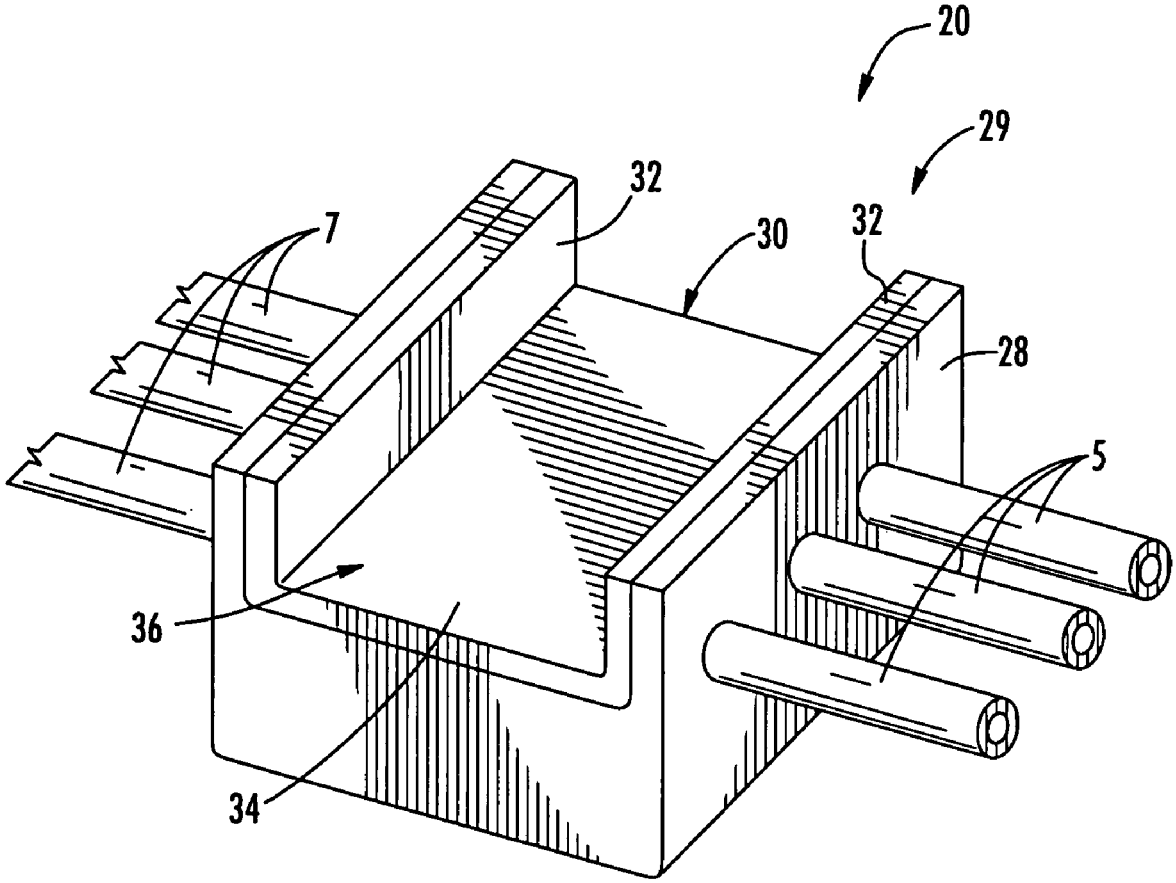
FIG. 3 is a bottom perspective view of the busbar assembly of FIG. 2.
Figure 4:
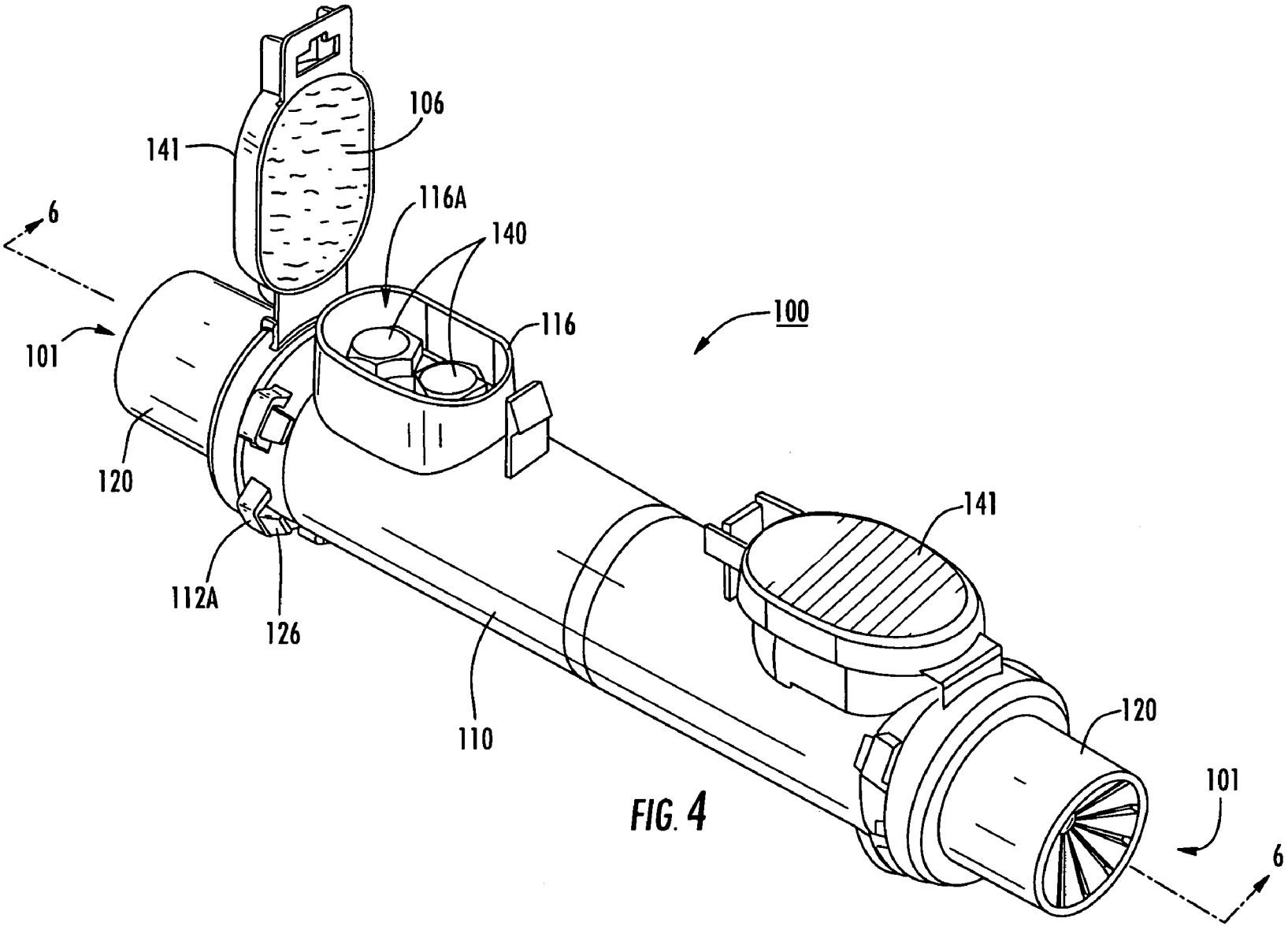
FIG. 4 is a perspective view of a limiter module forming apart of the electrical joint assembly of FIG. 1.
Figure 5:
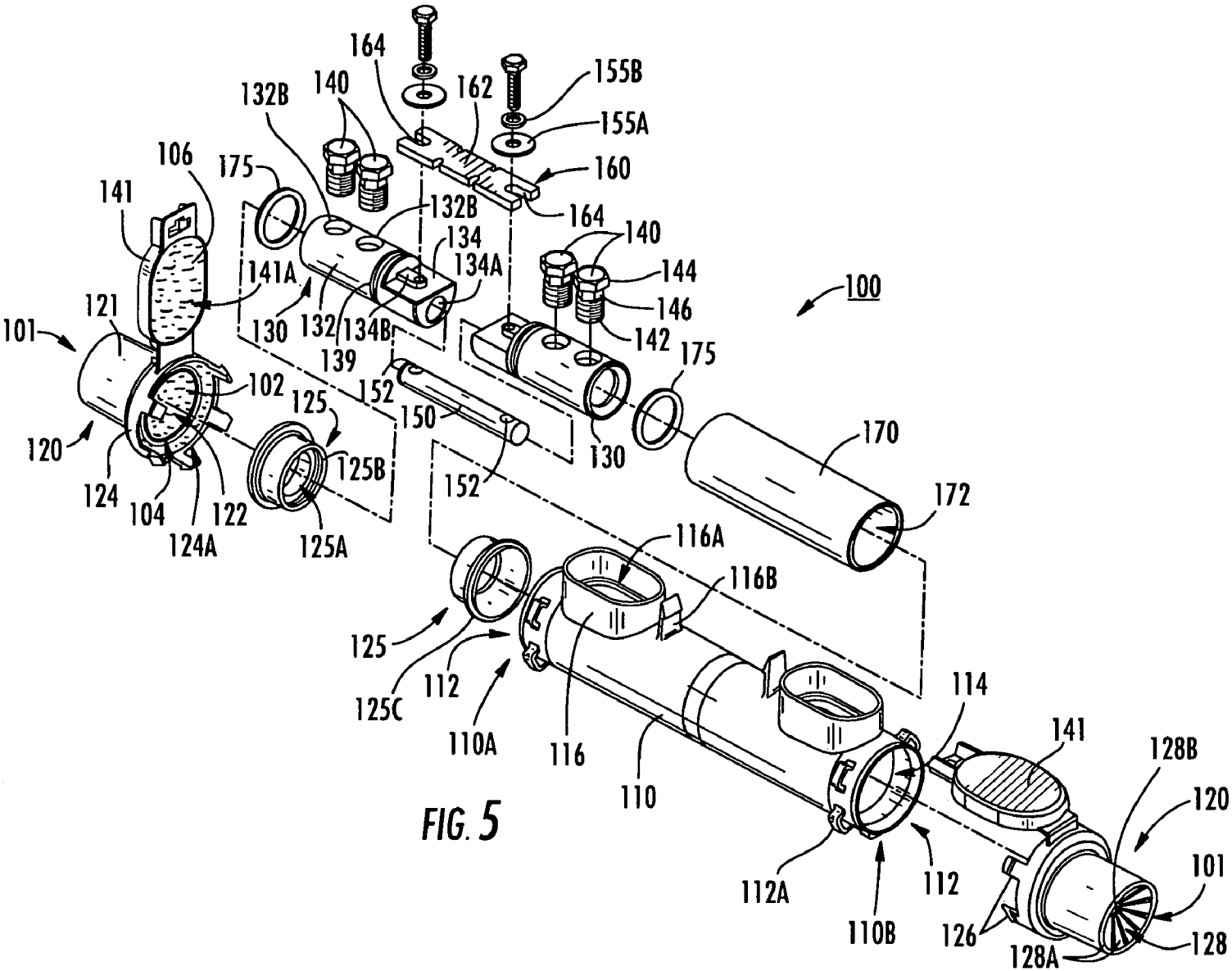
FIG. 5 is an exploded perspective view of the limiter module of FIG. 4.

According to some embodiments and with reference to FIGS. 1 and 3, the busbar hub 20 includes a substantially rigid liner or cover insert 30 that is integrated with the cover 28 to form a cover assembly 29. According to some embodiments, the cover insert 30 is configured to operably engage the support fixture B to stably support the busbar hub 20. As illustrated, the cover insert 30 has walls 32, 34 forming a U-shaped rail defining a channel 36 sized and shaped to slidably receive the support fixture B. In use, an operator can pull the joint assembly 10 out from the wall W by sliding the busbar hub 20 along the support fixture B, and can thereafter slide the joint assembly 10 back into position against or proximate the wall W.

According to some embodiments, the cover insert 30 is formed of an abrasion resistant material. According to some embodiments, the cover insert 30 is formed of an electrically insulating material. According to some embodiments, the cover insert 30 is formed of a material having a low coefficient of friction with respect to the intended support bracket. According to some embodiments, the cover insert 30 and the cover 28 are formed of different materials and the material of the cover insert 30 has a higher abrasion resistance than the material of the cover 28. According to some embodiments, the cover 28 is formed of EPDM and the cover insert 30 is formed of ultra high molecular weight polyethylene (UHMWPE) or polyurethane. The higher abrasion resistance and slipperiness of the cover insert 30 may permit the operator to more easily move the busbar hub 20 (e.g., by sliding on the support bracket B) without damaging the cover 28.

According to some embodiments, the cover 28 is overmolded onto the plates 24, bolts 26 and cables 5, 7. The cover insert 30 may be insert molded with, adhered or laminated to, mechanically fastened to, or otherwise secured to the cover 28. According to some embodiments, the cover 28 fully surrounds the plates 24, bolts 26 and cables 5, 7 except where the cables 5, 7 pass through the cover 28, and a portion of the cover 28 is interposed between the plates 24 and the cover insert 30.

According to other embodiments, the cover insert 30 may be otherwise shaped and/or may not be rigid. For example, the cover insert 30 as illustrated may be replaced with a non-rigid or flat abrasion resistant layer of material on an outer surface of the cover assembly 29, the abrasion resistant layer having an abrasion resistance great than that of the cover 28.

The busbar plates 24 may be formed of any suitable electrically conductive material. In some embodiments, the busbar plates 24 are formed of copper or aluminum. The busbar plates 24 may be formed by molding, casting, extrusion and/or machining, or by any other suitable process(es).

Figure 6:
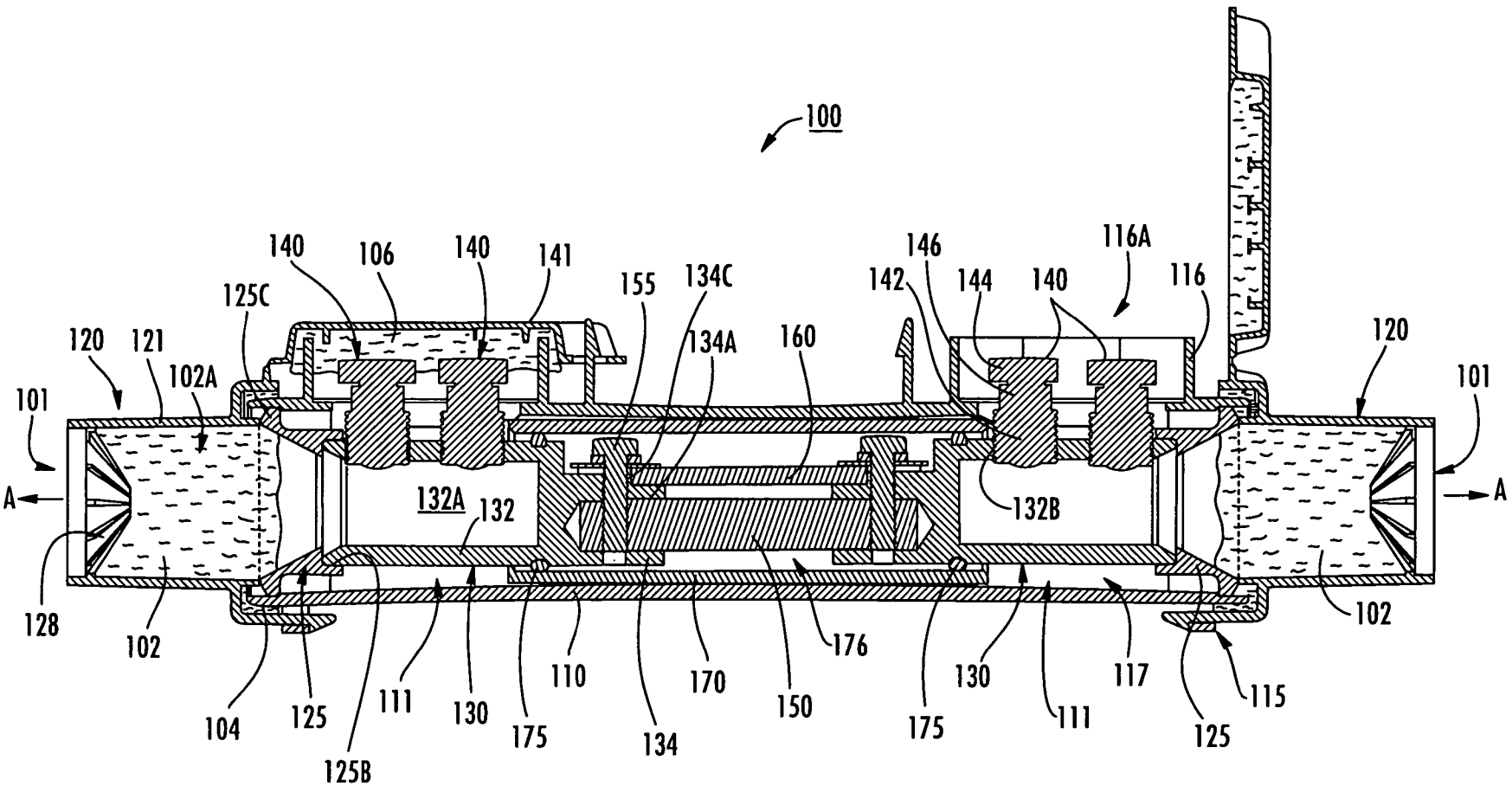
FIG. 6 is a cross-sectional view of the limiter module of FIG. 4 taken along the line 6-6 of FIG. 4.

Turning to the limiter module 100 in more detail and with reference to FIGS. 4-7, the limiter module 100 has two opposed ports 101. The limiter module 100 includes a housing 110 (having opposed ends 110A, 110B (FIG. 5)), a pair of module subassemblies 111 (FIG. 6), a coupling bar or bridge member 150, a fuse element 160, and a fuse subhousing 170. Each subassembly 111 is mounted on or adjacent a respective end 110A, 110B of the housing 110. The subassemblies 111 are mechanically coupled by the bridge member 150, the fuse element 160, and the fuse subhousing 170, which extend between the subassemblies 111 through the housing 110. The subassemblies 111 are electrically connected by the fuse element 160. Each subassembly 111 includes a port sealant mass 102, a flange sealant mass 104, an access sealant mass 106, a cable port member 120, an end ring 125, a connector member 130, a pair of removable shear bolts 140, a cap 141, a bridge bolt 155, and an O-ring 175. The housing 110 and the cable port members 120 together form a housing assembly 115 defining an enclosed interior chamber 117 (FIG. 6). According to some embodiments, the interior chamber 117 is environmentally protected and, in some embodiments, submersible or waterproof.

Each of the foregoing components will be discussed in greater detail below. Regarding the subassemblies 111, only one of the subassemblies 111 will be described in detail, it being understood that this description likewise describes the other subassembly 111.

The housing 110 is rigid and generally tubular and has opposed end openings 112. A housing passage 114 extends through the housing 110 and communicates with each of the end openings 112. Access ports 116A are defined in the side of the housing 110 and are surrounded by respective annular walls or flanges 116. Latch features 116B are located adjacent the access ports 116A and latch features 112A are positioned adjacent the end openings 112.

According to some embodiments, the housing 110 is integrally formed. According to some embodiments, the housing 110 is integrally molded. The housing 110 may be formed of any suitable electrically insulative material. According to some embodiments, the housing 110 is formed of a translucent material and, according to some embodiments, a transparent material. According to some embodiments, the housing 110 is formed of a translucent or transparent material such as polycarbonate, clarified PP, or methyl pentene. The housing 110 may be formed of a flame retardant material. Other suitable materials may include Plexiglass™ or Ultem™ transparent polymer materials.

The cable port member 120 defines a port 101 and includes a tubular body 121. The body 121 defines a through passage 122 communicating with the port 101. A perimeter flange 124 surrounds and projects axially inwardly and radially outwardly from the body portion 121. A plurality of barbed latch projections 126 extend forwardly from the flange 124. An annular groove 124A is defined in the flange 124. The sealant 102 is disposed in the passage 122 and the sealant 104 is disposed in the groove 124A. According to some embodiments, the sealant 102 is a gel sealant. According to some embodiments, the sealant 104 is a gel sealant. According to some embodiments, both of the sealants 102, 104 are gel sealants.

A penetrable closure wall 128 extends across the passage 122 between the open ends of the port member 120. The closure wall 128 may be integrally molded with the body 121. The closure wall 128 includes a plurality of discrete fingers or flaps 128A, which may be separated by gaps. The flaps 128A are flexible. According to some embodiments, the flaps 128A are also resilient.

According to some embodiments, the flaps 128A are concentrically arranged and taper inwardly in an inward direction from the entrance opening to the exit opening to form a generally conical or frusto-conical shape. According to some embodiments, the angle of taper is between about 10 and 60 degrees. The closure wall 128 defines a hole 128B that may be centrally located. According to some embodiments, the inner diameter of the hole 128B is less than the outer diameter of the cable or cables (e.g., the cable 5) with which the cable port member is intended to be used. The thickness of the flaps 128A may taper in a radially inward direction.

In some embodiments and as illustrated, the sealant 102 extends from the inner side of the closure wall 128 to the inner open end of the port member 120. The closure wall 128 and the body 121 define a sealing chamber or region 102A therebetween (FIG. 6). According to some embodiments, the sealant 102 substantially fills the sealing region 102A.

According to some embodiments, the cable port member 120 is integrally formed. According to some embodiments, the cable port member 120 is integrally molded. According to some embodiments, the cable port member 120 is integrally molded with a cap 141 as shown to form a living hinge therebetween. The cable port member 120 may be formed of any suitable electrically insulative material. According to some embodiments, the cable port member 120 is formed of polypropylene. The cable port member 120 may be formed of a flame retardant material.

The end ring 125 defines a through passage 125A (FIG. 5), an annular front groove 125B and a rear, annular, radially outwardly extending flange 125C. The inner surface of the end ring 125 is funnel-shaped (e.g., in the form of a frusto-cone tapering in the forward direction.

According to some embodiments, the end ring 125 is molded. The end ring 125 may be formed of any suitable electrically insulative material. According to some embodiments, the end ring 125 is formed of polycarbonate or Delrin. The end ring 125 may be formed of a flame retardant material.

The connector member 130 includes a main body 132, a cable bore 132A, a fuse coupling portion 134, a bridge bore 134A, a key feature 134B, a pair of threaded connector bolt bores 132B, a bridge bolt bore 134C (FIG. 6) and an annular O-ring groove 139. The entrance end of the cable bore 132A tapers inwardly.

The connector member 130 may be formed of any suitable electrically conductive material. In some embodiments, the connector member 130 is formed of copper or aluminum. The connector member 130 may be formed by molding, stamping, extrusion and/or machining, or by any other suitable process (es).

The shear bolts 140 each include a threaded base or shank 142, a primary head 144 and a secondary head 146. The primary heads 144 and the secondary heads 146 have different sizes from one another. According to some embodiments, the primary heads 144 have a larger diameter than the secondary heads 146. The primary heads 144 of the shear bolts 140 are configured to provide controlled maximum torque. According to some embodiments and as illustrated, the shear bolts 140 are single plane shear bolts. Other suitable types and designs of shear bolts may be used. The shear bolts 140 may be formed of any suitable material such as, for example, brass or copper.

The cap 141 defines an interior cavity 141A. The sealant 106 is disposed in the cavity 141A. According to some embodiments, the cap 141 is integrally molded. As illustrated, the cap 141 is pivotally connected to the cable port member 120 by a living hinge. The cap 141 may be formed of any suitable electrically insulative material. According to some embodiments, the cap 141 is formed of polypropylene. The cap 141 may be formed of a flame retardant material.

The bridge member 150 includes two through bores 152 formed on either end thereof. The bridge member 150 is formed of a rigid, electrically insulative material. According to some embodiments, the bridge member 150 is integrally molded. The bridge member 150 may be formed of any suitable electrically insulative material. According to some embodiments, the bridge member 150 is formed of fiberglass or phenolic. The bridge member 150 may be formed of a flame retardant material.

The fuse element 160 includes a fuse body 162 and has key recesses 164 defined in opposed ends of the body 162. The fuse element 160 may be formed of any suitable electrically conductive material. According to some embodiments, the fuse element 160 is formed of zinc. The fuse element 160 may also be formed of copper or silver. While a flat, serpentine fuse element configuration is illustrated, other configurations may be employed. According to some embodiments, the fuse element 160 is adapted to protect secondary cables sized from about 1/0 to 1000 kcmil.

The fuse subhousing 170 is tubular and defines a through passage 172. According to some embodiments, the fuse subhousing 170 is integrally molded. The fuse subhousing 170 may be formed of any suitable electrically insulative material. According to some embodiments, the fuse subhousing 170 is formed of a translucent material and, according to some embodiments, a transparent material. According to some embodiments, the fuse subhousing 170 is formed of a translucent or transparent material such as polycarbonate, clarified PP, or methyl pentene. The fuse subhousing 170 may be formed of a flame retardant material. Other suitable materials may include glass or Pyrex™ glass.

The O-ring 175 may be formed of any suitable electrically insulative material. According to some embodiments, the O-ring 175 is formed of Viton or silicone rubber. The O-ring 175 may be formed of a flame retardant material.

The sealants 102, 104, 106 may be any suitable sealants. As discussed above, one or more of the sealants 102, 104, 106 may be gel sealants. According to some embodiments, all of the sealants 102, 104, 106 are gel sealants. As used herein, "gel" refers to the category of materials which are solids extended by a fluid extender. The gel may be a substantially dilute system that exhibits no steady state flow. As discussed in Ferry, "Viscoelastic Properties of Polymers," 3$^{rd}$ ed. P. 529 (J. Wiley & Sons, New York 1980), a polymer gel may be a cross-linked solution whether linked by chemical bonds or crystallites or some other kind of junction. The absence of the steady state flow may be considered to be the definition of the solid-like properties while the substantial dilution may be necessary to give the relatively low modulus of gels. The solid nature may be achieved by a continuous network structure formed in the material generally through crosslinking the polymer chains through some kind of junction or the creation of domains of associated substituents of various branch chains of the polymer. The crosslinking can be either physical or chemical as long as the crosslink sites may be sustained at the use conditions of the gel.

Gels for use in this invention may be silicone (organopolysiloxane) gels, such as the fluid-extended systems taught in U.S. Pat. No. 4,634,207 to Debbaut (hereinafter "Debbaut '207"); U.S. Pat. No. 4,680,233 to Camin et al.; U.S. Pat. No. 4,777,063 to Dubrow et al.; and U.S. Pat. No. 5,079,300 to Dubrow et al. (hereinafter "Dubrow '300"), the disclosures of each of which are hereby incorporated herein by reference. These fluid-extended silicone gels may be created with non-reactive fluid extenders as in the previously recited patents or with an excess of a reactive liquid, e.g., a vinyl-rich silicone fluid, such that it acts like an extender, as exemplified by the Sylgard® 527 product commercially available from Dow-Corning of Midland, Mich. or as disclosed in U.S. Pat. No. 3,020,260 to Nelson. Because curing is generally involved in the preparation of these gels, they are sometimes referred to as thermosetting gels. The gel may be a silicone gel produced from a mixture of divinyl terminated polydimethylsiloxane, tetrakis (dimethylsiloxy)silane, a platinum divinyltetramethyldisiloxane complex, commercially available from United Chemical Technologies, Inc. of Bristol, Pa., polydimethylsiloxane, and 1,3,5,7-tetravinyltetra-methylcyclotetrasiloxane (reaction inhibitor for providing adequate pot life).

Other types of gels may be used, for example, polyurethane gels as taught in the aforementioned Debbaut '261 and U.S. Pat. No. 5,140,476 to Debbaut (hereinafter "Debbaut '476") and gels based on styrene-ethylene butylenestyrene (SEBS) or styrene-ethylene propylene-styrene (SEPSS) extended with an extender oil of naphthenic or nonaromatic or low aramatic content hydrocarbon oil, as described in U.S. Pat. No. 4,369,284 to Chen; U.S. Pat. No. 4,716,183 to Gamarra et al.; and U.S. Pat. No. 4,942,270 to Gamarra. The SEBS and SEPS gels comprise glassy styrenic microphases interconnected by a fluid-extended elastomeric phase. The microphase-separated styrenic domains serve as the junction points in the systems. The SEBS and SEPS gels are examples of thermoplastic systems.

Another class of gels which may be used are EPDM rubber-based gels, as described in U.S. Pat. No. 5,177,143 to Chang et al. Yet another class of gels which may be used are based on anhydride-containing polymers, as disclosed in WO 96/23007. These gels reportedly have good thermal resistance.

The gel may include a variety of additives, including stabilizers and antioxidants such as hindered phenols (e.g., IrganoX™ 1076, commercially available from Ciba-Geigy Corp. of Tarrytown, N.Y.), phosphites (e.g., Irgafos™ 168, commercially available from Ciba-Geigy Corp. of Tarrytown, N.Y.), metal deactivators (e.g., Irganox™ D1024 from Ciba-Geigy Corp. of Tarrytown, N.Y.), and sulfides (e.g., Cyanox LTDP, commercially available from American Cyanamid Co. of Wayne, N.J.), light stabilizers (e.g., Cyasorb UV-531, commercially available from American Cyanamid Co. of Wayne, N.J.), and flame retardants such as halogenated paraffins (e.g., Bromoklor 50, commercially available from Ferro Corp. of Hammond, Ind.) and/or phosphorous containing organic compounds (e.g., Fyrol PCF and Phosflex 390, both commercially available from Akzo Nobel Chemicals Inc. of Dobbs Ferry, N.Y.) and acid scavengers (e.g., DHT-4A, commercially available from Kyowa Chemical Industry Co. Ltd through Mitsui & Co. of Cleveland, Ohio, and hydrotalcite). Other suitable additives include colorants, biocides, tackifiers and the like described in "Additives for Plastics, Edition 1" published by D.A.T.A., Inc. and The International Plastics Selector, Inc., San Diego, Calif.

The hardness, stress relaxation, and tack may be measured using a Texture Technologies Texture Analyzer TA-XT2 commercially available from Texture Technologies Corp. of Scarsdale, N.Y., or like machines, having a five kilogram load cell to measure force, a 5 gram trigger, and ¼ inch (6.35 mm) stainless steel ball probe as described in Dubrow '300, the disclosure of which is incorporated herein by reference in its entirety. For example, for measuring the hardness of a gel a 60 mL glass vial with about 20 grams of gel, or alternately a stack of nine 2 inch×2 inch×⅛" thick slabs of gel, is placed in the Texture Technologies Texture Analyzer and the probe is forced into the gel at the speed of 0.2 mm/sec to a penetration distance of 4.0 mm. The hardness of the gel is the force in grams, as recorded by a computer, required to force the probe at that speed to penetrate or deform the surface of the gel specified for 4.0 mm. Higher numbers signify harder gels. The data from the Texture Analyzer TA-XT2 may be analyzed on an IBM PC or like computer, running Microsystems Ltd, XT.RA Dimension Version 2.3 software.

The tack and stress relaxation are read from the stress curve generated when the XT.RA Dimension version 2.3 software automatically traces the force versus time curve experienced by the load cell when the penetration speed is 2.0 mm/second and the probe is forced into the gel a penetration distance of about 4.0 mm. The probe is held at 4.0 mm penetration for 1 minute and withdrawn at a speed of 2.00 mm/second. The stress relaxation is the ratio of the initial force ($F_i$) resisting the probe at the pre-set penetration depth minus the force resisting the probe ($F_f$) after 1 min divided by the initial force $F_i$, expressed as a percentage. That is, percent stress relaxation is equal to $$\frac{(F_i - F_f)}{F_i} \times 100\%$$

where $F_i$ and $F_f$ are in grams. In other words, the stress relaxation is the ratio of the initial force minus the force after 1 minute over the initial force. It may be considered to be a measure of the ability of the gel to relax any induced compression placed on the gel. The tack may be considered to be the amount of force in grams resistance on the probe as it is pulled out of the gel when the probe is withdrawn at a speed of 2.0 mm/second from the preset penetration depth.

An alternative way to characterize the gels is by cone penetration parameters according to ASTM D-217 as proposed in Debbaut '261; Debbaut '207; Debbaut '746; and U.S. Pat. No. 5,357,057 to Debbaut et al., each of which is incorporated herein by reference in its entirety. Cone penetration ("CP") values may range from about 70($10^{-1}$ mm) to about 400($10^{-1}$ mm). Harder gels may generally have CP values from about 70($10^{-1}$ mm) to about 120($10^{-1}$ mm). Softer gels may generally have CP values from about 200 ($10^{-1}$ mm) to about 400($10^{-1}$ mm), with particularly preferred range of from about 250($10^{-1}$ mm) to about 375 ($10^{-}$ mm). For a particular materials system, a relationship between CP and Voland gram hardness can be developed as proposed in U.S. Pat. No. 4,852,646 to Dittmer et al.

According to some embodiments, the gel has a Voland hardness, as measured by a texture analyzer, of between about 5 and 100 grams force. The gel may have an elongation, as measured by ASTM D-638, of at least 55%. According to some embodiments, the elongation is of at least 100%. The gel may have a stress relaxation of less than 80%. The gel may have a tack greater than about 1 gram. Suitable gel materials include POWERGEL sealant gel available from Tyco Electronics Energy Division of Fuquay-Varina, NC under the RAYCHEM brand. According to some embodiments, the hardness of the gel 106 in the cap 141 is greater than the hardness of the port gel 102.

Referring to FIG. 2, the busbar hub 20 may be formed by clamping bare sections of the conductors 5A (which may be ring stripped) in the grooves 24A of the busbar plates 24 and clamping the conductors 5A in place using the bolts 26. The over-insulation 28 (FIG. 1) may be applied using any suitable technique, which may include dipping, injection over-molding, or compression over-molding. Alternatively or additionally, a sealant (e.g., gel or mastic) filled enclosure may be used.

The limiter module 100 may be formed in the following manner. However, other techniques, orders of steps, etc. may be used.

The sealant 102 is deposited in the passage 122, the sealant 104 is deposited in the groove 124A, and the sealant 106 is deposited in the cavity 141A. The sealants 102, 104, 106 may be cured in situ.

The ends of the bridge member 150 are inserted into the bores 134A of the connector members 130. The fuse element 160 is placed on the fuse coupling portions 134 such that the key features 134B are received in the recesses 164. The fuse element 160 and the bridge member 150 are secured to the connector members 130 by the bolts 155, flat washers 155A and lock washers 155B. In this manner, the connector members 130, the fuse element 160 and the bridge member 150 are configured as a substantially rigid, unitary assembly. The bridge member 150 prevents or reduces relative movement between the connector members 130 that might otherwise place mechanical stresses on the fuse element 160. The lock washers 155B serve as resilient biasing devices to accommodate fluctuations in the shape of the fuse element 160 and other components due to electrical load cycling. According to some embodiments, the height of the key features 134B is less than the adjacent thickness of the fuse element to ensure that the fuse element 160 is consistently properly loaded by the bolts 155.

The O-rings 175 are mounted in the grooves 139 of the connector members 130. The fuse subhousing 170 is slid onto the connector members 130 to form a fuse subchamber 176 (FIG. 6). The fuse subchamber 176 is environmentally sealed by the O-rings 175 and contains the fuse element 160.

The foregoing subassembly is then inserted into the housing 110. The threaded bores 132B are aligned with the ports 116A. The shear bolts 140 are partially installed into the bores 132B so that the cable bores 132A remain open for insertion of the conductors 5A, 7A.

The end rings 125 are inserted into either end of the housing 110. The port members 120 are mounted on the ends of the housing 110 such that the latch projections 126 interlock with the latch features 112A. Endmost portions of the housing 110 are received in the grooves 124A and sealant 104 of the port members 120 to form environmental seals between the flanges 124 and the housing 110. The port member passage 122 is likewise environmentally sealed by the sealant 102.

Each end ring 125 is sandwiched between the adjacent port member 120 and connector member 130. The end rings 125 serve to radially center the connector members 130 and the fuse element 160 in the housing 110. According to some embodiments, the end rings 125 are placed under axial compression so that they serve to frictionally link the connector members 130 to the rotationally fixed port members 120 to thereby inhibit rotation of the connector members 130 in the housing 110.

The end of each connector member 130 is received in the groove 125B of the abutting end ring 125. According to some embodiments, the passage 125A of the end ring tapers to a diameter less than the diameter of the cable bore 132A. According to some embodiments, the entrance to the cable bore 132A is chamfered to provide a smooth transition from the end ring 125 to the cable bore 132A.

The caps 141 are mounted on the annular walls 116. Endmost portions of the walls 116 are received in the sealant 106 to environmentally seal the access ports 116A. The caps 141 are latched closed using the latch projections 116B.

The busbar hub 20 and the limiter modules 100 may be used in the following manner. By way of example, the limiter module 100 may be used to form a fusible connection in the crab joint assembly 10 as shown in FIG. 1. However, other techniques, orders of steps, etc. may be used. For example, the order of installing the cables 5 and 7 may be reversed. The limiter module 100 may be installed between electrically live cables 5, 7. According to some embodiments, one or both of the conductors 5A, 7A are stranded conductors.

Figure 7:
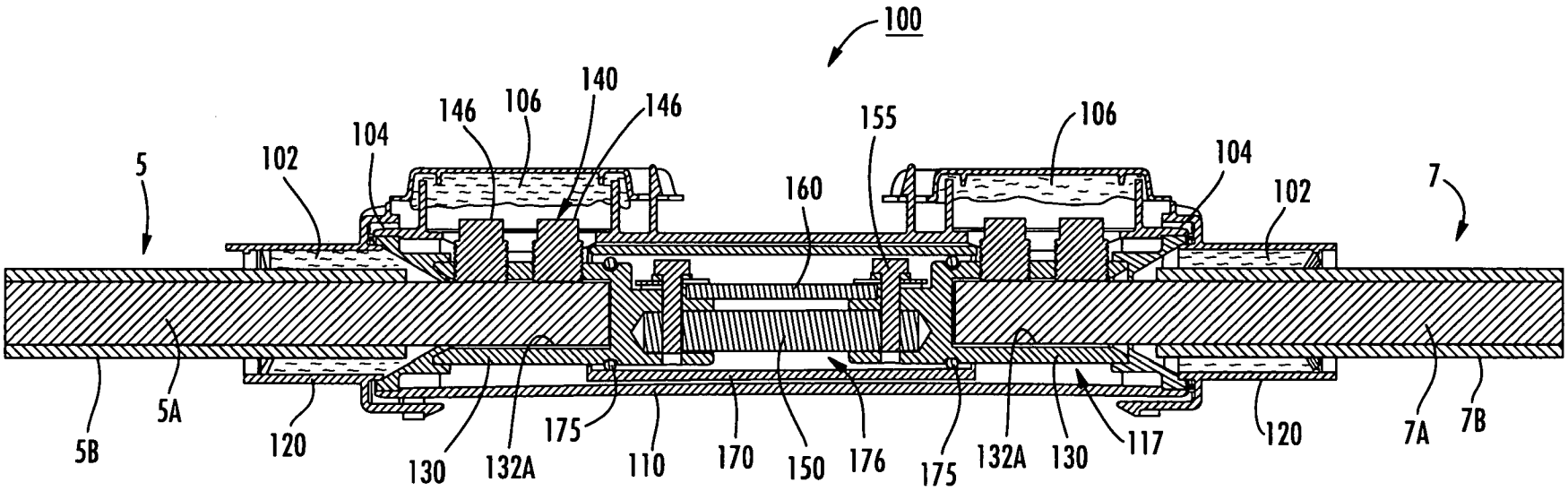
FIG. 7 is a cross-sectional view of the limiter module of FIG. 4 including a pair of cables mounted therein.

The cover 5B is trimmed to expose a terminal end portion of the conductor 5A. With the shear bolts 140 in a raised position, the cable 5 is inserted into the selected port 120 such that the terminal end of the conductor 5A is inserted through the passages 122, 125A and into the cable bore 132A. The cable 5 penetrates and/or displaces the closure wall 128 and the sealant 102 as shown in FIG. 7. The cable 5 may elastically deflect the flaps 128A of the closure wall 128. The funnel shape of the end ring 125 may help to ensure that the conductor 5A is routed into the cable bore 132A without abutting a surface or edge in a manner that may damage the conductor 5A (e.g., by bending out a strand of the conductor 5A). The end ring 125 may function to wipe and/or shear the sealant 102 (e.g., gel sealant) from the conductor 5A as the conductor 5A passes through the end ring 125 and into the connector member 130. The limiter module 100 may be configured such that a volume of a compressible gas (e.g., air) is provided to accommodate displacement of the sealant 102 when the cable 5 is inserted.

The operator then opens the cap 141 and engages the primary head 144 of each shear bolt 140 in the associated connector member 130 with a suitable driver (e.g., an electrically insulated powered or nonpowered driver) and rotatively drives the bolt 140 into the corresponding threaded bore 132B (FIG. 6) to force the exposed portion of the conductor 5A against the opposing wall of the cable bore 132A. The operator continues to the drive the shear bolt 140 until, at a prescribed load, the primary head 144 shears off of the bolt 140. In this manner, the cable 5 is mechanically secured to or captured within the limiter module 100 and electrically connected to the cable bore 132A. A proper connection can be ensured by the use of the shear bolts 140.

The other cable 7 is inserted through the opposing port member 120 and secured in the opposing connector member 130 using the other set of shear bolts 140 in the same manner as described above. In this manner, the cables 5, 7 are thereby electrically connected to one another through the connector members 130 and fuse 160. According to some embodiments and as illustrated, the cables 5, 7 are inserted and, when secured, oriented along the same axis A-A.

In service, the limiter module 100 may perform in conventional manner to fusibly connect the cables 5, 7. During normal operation, current passes between the conductors 5A, 7A through the limiter module 100 via the connector members 130 and the fuse element 160. The O-rings 175 may serve as shock absorbers to damp vibration to the housing 110 and the subhousing 170 from the cables 5, 7 (e.g., when the cables 5, 7 vibrate at higher currents). The O-rings 175 may also serve to thermally insulate the subhousing 170 from the connectors 130.

When the fuse element 160 blows, the fuse element 160 will generate smoke, soot and/or other byproducts. These byproducts fill the fuse chamber 176 and are visible through the translucent or transparent housing 110 and the subhousing 170, which form a viewing window. In this manner, the limiter module 100 provides an externally visible indicia of the status of the limiter module (i.e., clear=OK, dark residue=blown or failed).

The subhousing 170 and the O-rings 175 (which seal the fuse chamber 176) may also serve to contain the fuse failure byproducts to prevent or reduce contamination of the cables 5, 7. This may advantageously eliminate the need to further prepare or replace the cables 5, 7 for reconnection to the network. Such containment may also prevent the fuse byproducts from escaping into the surrounding environment. Further containment may be provided by the housing 110 and the sealant-filled port members 120.

Notwithstanding the blowing of the fuse element 160, the bridge member 150 will remain intact and continue to maintain the relative positions of the connector members 130. In particular, the bridge member 150 will maintain the connector members in electrical isolation from one another.

The limiter module 100 may thus enable an operator to readily identify the blown limiter module. If desired, the operator can confirm that the fuse element 160 has blown by opening the caps 141 and using shear bolts 140 on each connector member 130 as contacts to test for electrical continuity between the connector members 130. The operator may then remove or disconnect the limiter module 100 from the cables 5, 7 and replace it with a new limiter module 100. More particularly, the operator can open the caps 141 and back out the shear bolts 140 by engaging a driver with the secondary heads 146 of the shear bolts 140. The cables 5, 7 can then be withdrawn and the new limiter module 100 mounted on the cables 5, 7 in the manner described above. This replacement procedure may be accomplished without discarding, damaging, modifying or affecting the busbar hub 70, the other limiter modules 100 or the other cables 7 of the joint assembly 10. Advantageously, the limiter modules 100 of the crab joint assembly 10 are independently or individually replaceable so that the entirety of the crab joint assembly 10 need not be discarded as in conventional crab joints.

Thus, when employed in a network or grid, the limiter module 100 and the crab joint assembly 10 may significantly accelerate the process of locating a blown fuse and restoring of the grid to its original condition by visually indicating the fuse condition and permitting individual replacement of the blown limiter module 100.

The limiter module 100 may provide improved efficiency and operator safety when disconnected or installed on electrically hot conductors. The limiter module 100 may reduce, prevent or minimize the operator's exposure to electrically hot conductors. For example, according to some embodiments, when a cable 5 is being inserted into the limiter module 100, the sealant 102 (particularly gel sealant as described herein) will insulate the conductor 5A from the receiving connector member 130 until the conductor 5A is fully contained within the sealant 102 and the housing 110. As a result, any arcing that occurs between the conductor 5A and the connector member 130 will be contained within the limiter module 100, thereby shielding the operator. The sealant 102 may also quench or inhibit such arcing until the conductor 5A is in or in close proximity to the connector member 130, thereby minimizing the distance of arcing.

The limiter module 100 may provide a reliable (and, in at least some embodiments, moisture-tight) seal between the limiter module 100 and the cables 5, 7. The sealant 102, particularly gel sealant, may accommodate cables of different sizes within a prescribed range.

When the sealant 102 is a gel, each cable 5, 7 and the limiter module 100 apply a compressive force to the sealant 102 as the cable 5, 7 is inserted into the limiter module 100. The gel is thereby elongated and is generally deformed and substantially conforms to the outer surface of the cable 5, 7 and to the inner surfaces of the limiter module 100. Some shearing of the gel may occur as well. Preferably, at least some of the gel deformation is elastic. The restoring force in the gel resulting from this elastic deformation causes the gel to operate as a spring exerting an outward force between the limiter module 100 and the cable 5, 7. According to some embodiments, the limiter module 100 is adapted such that, when the cable 5, 7 is installed in the port 101, the gel 102 has an elongation at the interface between the gel 102 and the inner surface of the port member body 121 of at least 1000%.

Various properties of the gel, as described above, may ensure that the gel sealant 102 maintains a reliable and long lasting hermetic seal between the limiter module 100 and the cable 5, 7. The elastic memory and the retained or restoring force in the elongated, elastically deformed gel generally cause the gel to bear against the mating surfaces of the cable 5, 7 and the interior surface of the port member body 121. Also, the tack of the gel may provide adhesion between the gel and these surfaces. The gel, even though it is cold-applied, is generally able to flow about the cable 5, 7 and the limiter module 100 to accommodate their irregular geometries.

Preferably, the sealant 102 is a self-healing or self-amalgamating gel. This characteristic, combined with the aforementioned compressive force between the cable 5, 7 and the limiter module 100, may allow the sealant 102 to re-form into a continuous body if the gel is sheared by the insertion of the cable 5, 7 into the limiter module 100. The gel may also re-form if the cable 5, 7 is withdrawn from the gel.

The sealants 102, 104, 106, particularly when formed of a gel as described herein, may provide a reliable moisture barrier for the cables 5, 7, the connector members 130 and the fuse element 160 even when the limiter module 100 is submerged or subjected to extreme temperatures and temperature changes. Preferably, the housing 110 and the port members 120 are made from abrasion-resistant materials that resist being punctured by abrasive forces.

While, in accordance with some embodiments, the sealants 102, 104, 106 are gels as described above, other types of sealants may be employed. For example, the sealants 102, 104, 106 may be silicone grease or hydrocarbon-based grease.

Various modifications may be made to the foregoing limiter module 100 in accordance with the present invention. For example, according to some embodiments, the closure walls 128 may be omitted.

The closure walls 128 may be otherwise constructed so as to be penetrable and displaceable. For example, the closure walls 128 may be constructed so as to be fully or partly frangible, to lack a preformed hole, and/or with or without a taper. As a further alternative, each closure wall may be constructed as a resilient, elastic membrane or panel having a preformed hole therein, the closure wall being adapted to stretch about the hole to accommodate the penetrating cable without rupturing. In such case, the hole is preferably smaller in diameter than the outer diameter of the intended cable. Closure walls of different designs and constructions may be used in the same connector as well as in the same port.

While two cable ports and conductor bores and two access ports are shown in the limiter module 100, limiter modules according to the present invention may include more or fewer cable ports and/or access ports and corresponding or associated components as needed to allow for the connection of more or fewer cables.

Figure 8:
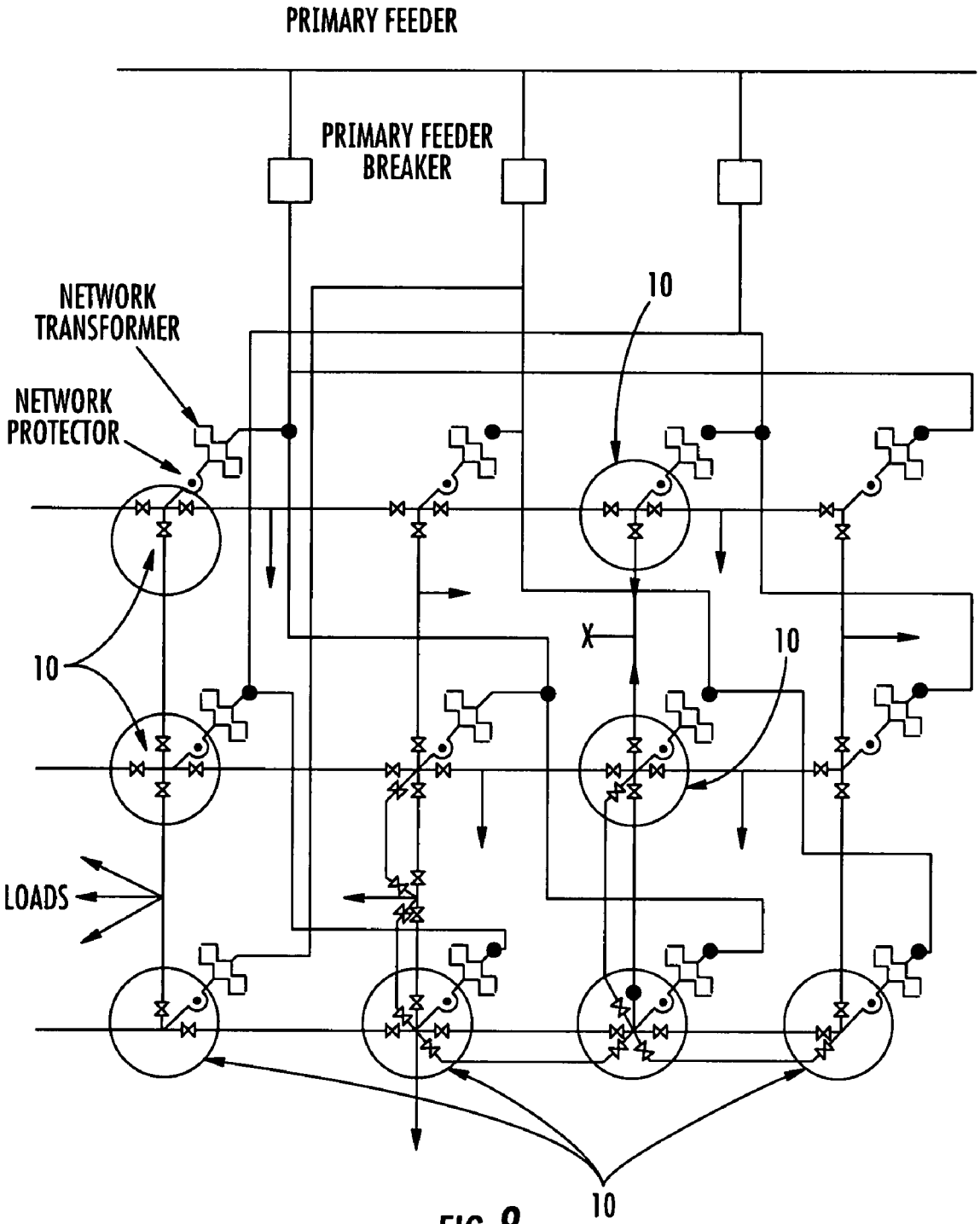
FIG. 8 is a schematic diagram of an exemplary secondary network distribution system including electrical joint assemblies according to embodiments of the present invention.

According to some embodiments, limiter modules and joint assemblies as described herein are used to connect cables in a secondary power distribution network. An exemplary secondary power distribution network is illustrated in FIG. 8. According to some embodiments, limiter modules and joint assemblies as described herein are used to connect cables in a secondary network distribution system operating at a voltage of 600 volts or less and, according to some embodiments, of about 120/208 volts. The joint assemblies and limiter modules may be installed in transformer vaults, manholes and secondary boxes.

As discussed above, according to some embodiments, limiter modules and joint assemblies as described herein are adapted or configured to be submersed in water under intended (including anticipated) in-service conditions without permitting surrounding water to contact exposed electrical conductors (including the connector members 130 and the fuse element 160) (referred to herein as "water submersible"). According to some embodiments, the limiter modules are water submersible in compliance with ANSI C119.1 Rev. dated Jan. 13, 2006.

According to some embodiments, the key features 134B are configured to fit the key recesses 164 of only prescribed fuse elements 160. In this manner, the key features 134B and key recesses 164 can ensure that only appropriately sized or rated fuse elements are used in the limiter module.

While the limiter module 100 includes a single access port 116A for the shear bolts 140 associated with each connector member 130, according to other embodiments, an access port is provided for each shear bolt.

While the joint assembly 10 as shown is a 3 way/3 way (6 legs) crab joint assembly, other configurations may be provided in accordance with embodiments of the present invention (e.g., 5 way/5 way (10 legs), 7 way/7 way (14 legs), etc.).

According to some embodiments of the present invention, the fuse element 160 is coated with a thermo-chromic paint. The thermo-chromic paint may be formulated to change color when the fuse element 160 has reached its known melt or failure temperature.

Figure 9:
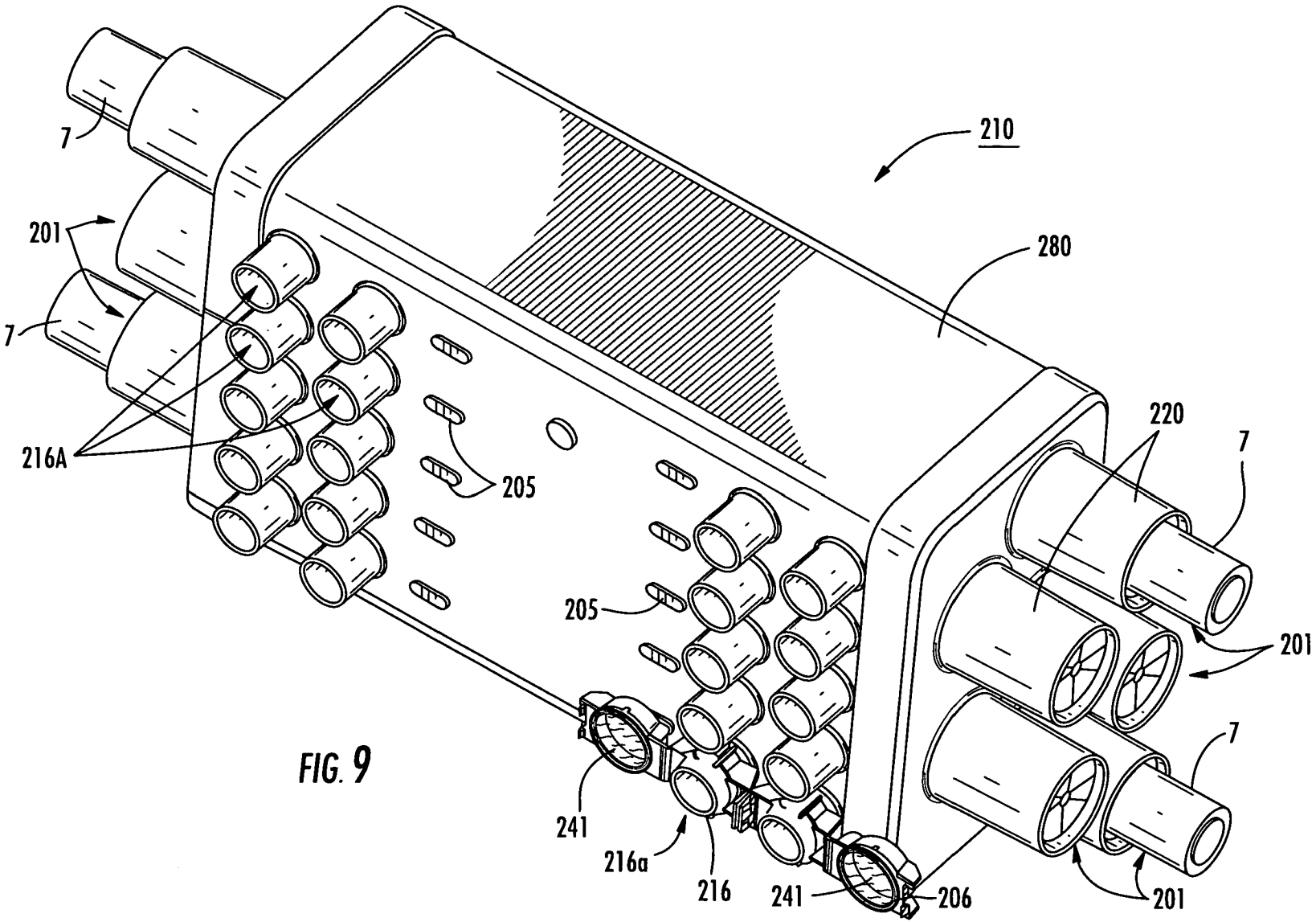
FIG. 9 is a perspective view of an electrical joint assembly according to further embodiments of the present invention.
Figure 10:
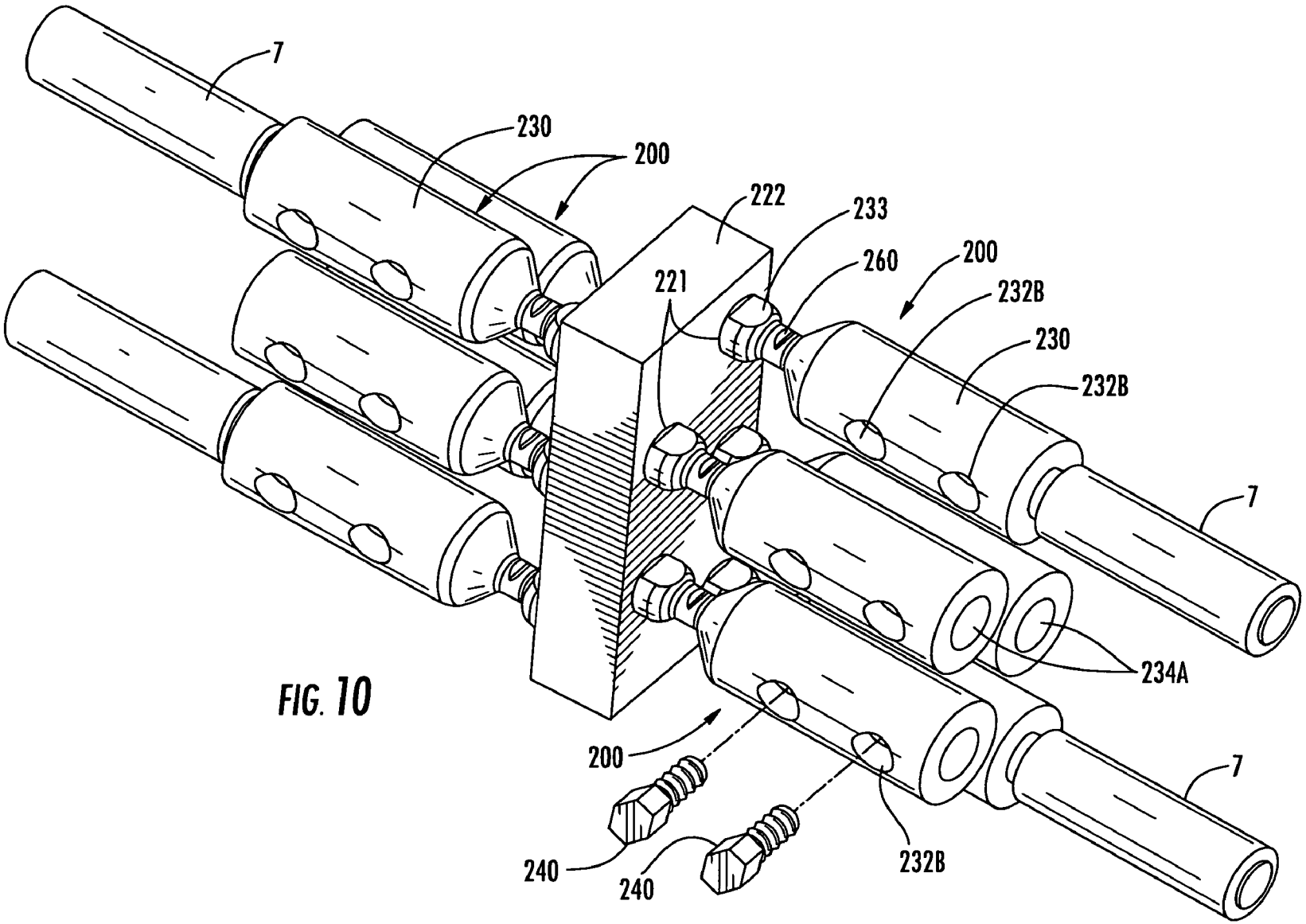
FIG. 10 is a fragmentary, perspective view of the electrical joint assembly of FIG. 9.

With reference to FIGS. 9 and 10, a joint assembly 200 according to further embodiments of the invention is shown therein. The joint assembly 200 includes a busbar 222 and a plurality (as shown, ten) of limiter subassemblies 200 integrated into a shared housing 280. The joint assembly 200 is shown in FIG. 10 with the housing 280 removed for the purpose of explanation.

The housing 280 may be formed of any suitable electrically insulating material. A cable port structure 220 integrally formed with the housing 280 is provided for each limiter subassembly 200. Each cable port structure 220 defines a port 201 and may be filled with a sealant corresponding to the sealant 102. Each cable port structure 220 may include features and be constructed as discussed above with regard to the cable port members 120.

A pair of access port structures 216 is also provided for each limiter subassembly 200. Each access port structure 216 defines and access port 216A and may be provided with a cap 241 (only two shown). The caps 241 may be filled with a sealant 206 corresponding to the sealant 106.

Referring to FIG. 10, the busbar 222 may be formed of any suitable electrically conductive material. The busbar 222 has threaded bores 221 formed therein.

Each limiter subassembly 200 includes a connector member 230. Each connector member 230 includes a cable bore 234A corresponding to the cable bore 134A and a pair of threaded bolt bores 232B corresponding to the bolt bores 132B. Each connector member 230 further includes an externally threaded head 233 and an integrally formed fuse portion 260. The fuse portion 260 has a reduced thickness (cross-sectional area) as compared to the cable 7. Each head 233 is engaged with a respective bore 221 to mechanically and electrically connect the associated connector member 230 with the busbar 222. In use, each fuse portion 260 operates as a meltable fuse. According to other embodiments, the fuse portions 260 may be replaced with other types or configurations of integrated or non-integrated fuses.

Each limiter subassembly 200 further includes a pair of bolts 240 that threadedly engage the bores 232B and can be used to secure the end of a cable 7 in the cable bore 234A of the associated connector member 230 to mechanically and electrically connect the cable 7 to the connector member 230. According to some embodiments, the bolts 240 are double headed shear bolts corresponding the shear bolts 140.

The joint assembly 210 can be used in a similar manner to the joint assembly 10. The cables 7 are inserted through the self-sealing cable ports 201 and into the cable bores 234A. The bolts 240 are accessed through the access ports 216A and driven into the connector members 230 to secure the cables 7. The self-sealing caps 241 can thereafter be closed to environmentally seal the housing 280.

The joint assembly 210 may be further provided with a detection circuit or switch and externally viewable lights (e.g., LEDs) 205 that are triggered thereby. The detection switch is operative to actuate one of the lights 205 when a corresponding one of the fuse portions 260 melts, thereby opening the circuit with the associated cable 7. An operator may use this visual indicia to readily locate the blown fuse and take desired corrective action. Such corrective action may include disconnecting the cable 7 from the busbar 222 and reconnecting the cable to a different fused connector member 230 of the busbar 222 or another busbar. Disconnection of the cable 7 may be facilitated by the shear bolts 240, which can be backed out to release the cable 7 without cutting it.

Figure 11:
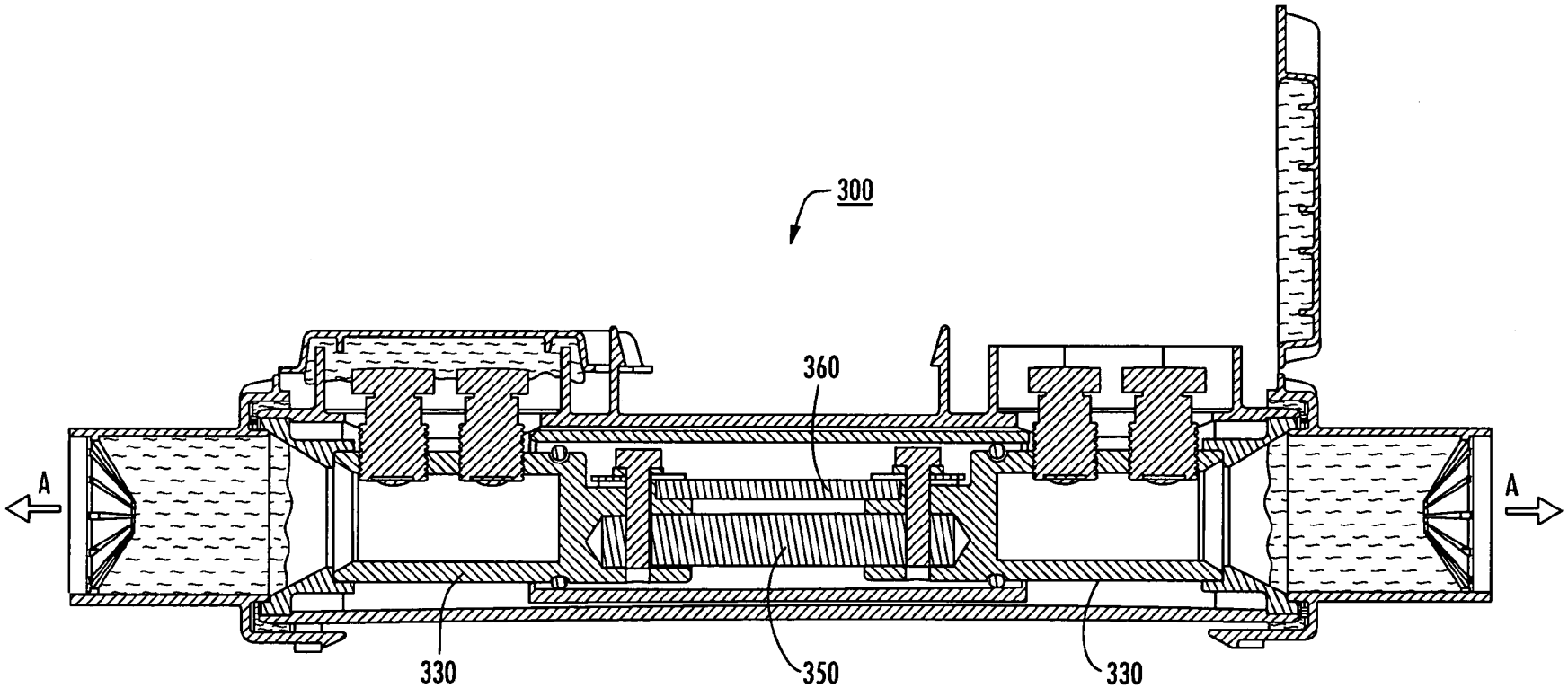
FIG. 11 is a cross-sectional view of an in-line splice connector module according to further embodiments of the present invention.

While the present invention has been described herein with reference to limiter modules, various of the features and inventions discussed herein may be provided in other types of connectors. For example, with reference to FIG. 11, a connector module 300 according to further embodiments of the present invention is shown therein. The connector module 300 corresponds to the limiter module 100 except as follows. The fuse element 160 is replaced with a link member 360 that is electrically conductive and configured to function as a fully conductive (nonfuse) electrical conductor between the connector members 330. For example, the link member 360 may be an appropriately sized copper link member. Alternatively (not shown), the connector members 330 may be unitarily integrally formed (e.g., by molding or machining) or otherwise electrically connected or the bridge member 350 may be replaced with a conductive bridge member. The subhousing 170 and O-rings 175 may be omitted. The conductors 5A, 7A of the cables 5, 7 are inserted into and secured in connector module 300 along a common (i.e., the same) axis A-A.

The connector module 300 may be incorporated into a joint assembly (e.g., crab joint) of the present invention as described herein with regard to the limiter module. For example, the connector module may be used to connect a feeder cable to the busbar hub 20.

Limiter modules (e.g., the limiter modules 100) and connector modules (e.g., the connector module 200) may also be used as in-line splice connectors apart from a busbar hub.

While the above-described limiter module 100 includes a translucent or transparent window (i.e., the sections of the housings 110 and 170 overlying the fuse element 160) to provide a visual indication of the status of the fuse element 160, limiter modules in accordance with further embodiments of the present invention may use other mechanisms. Such other mechanisms may include, for example, a mechanical flag or light (e.g., LED) triggered by blowing of the fuse.

Connectors according to the present invention may be adapted for various ranges of voltage. It is particularly contemplated that connector assemblies of the present invention employing aspects as described above may be adapted to effectively handle operating voltages in the range of 600 volts or less.

The foregoing is illustrative of the present invention and is not to be construed as limiting thereof. Although a few exemplary embodiments of this invention have been described, those skilled in the art will readily appreciate that many modifications are possible in the exemplary embodiments without materially departing from the novel teachings and advantages of this invention. Accordingly, all such modifications are intended to be included within the scope of this invention. Therefore, it is to be understood that the foregoing is illustrative of the present invention and is not to be construed as limited to the specific embodiments disclosed, and that modifications to the disclosed embodiments, as well as other embodiments, are intended to be included within the scope of the invention.

That which is claimed is:

1. An electrical joint assembly for connecting a plurality of conductors, the electrical joint assembly comprising:

a busbar hub including:

an electrically conductive busbar body; and a plurality of elongate conductor legs extending lengthwise from the busbar body; and a plurality of limiter modules each including a fuse element;

wherein each of the limiter modules is connected to a respective one of the conductor legs and is connectable to a respective conductor to provide a fuse controlled connection between the respective conductor leg and the respective conductor; and wherein each of the limiter modules is independently removable from the respective one of the conductor legs.

2. The electrical joint assembly of claim 1 wherein each of the limiter modules includes:

a port including a conductor passage configured to receive the respective conductor leg or the respective conductor; and sealant disposed in the conductor passage, the sealant being adapted for insertion of the respective conductor leg or the respective conductor therethrough such that the sealant provides an environmental seal about the inserted respective conductor leg or respective conductor.

3. The electrical joint assembly of claim 2 wherein the sealant is gel.

4. The electrical joint assembly of claim 2 wherein each of the limiter modules further includes:

an electrically insulating housing; and an electrically conductive connector member disposed in the housing, the connector member being configured to engage and form an electrical connection with the respective conductor leg or the respective conductor inserted through the conductor passage;

wherein the connector member is located interiorly of the sealant to inhibit or prevent exposed electrical arcing between the inserted respective conductor leg or respective conductor and the connector member.

5. The electrical joint assembly of claim 1 wherein each of the limiter modules includes:

an electrically conductive connector member configured to engage and form an electrical connection with the respective conductor leg or the respective conductor inserted through the conductor passage; and a shear bolt to controllably secure the respective conductor leg or the respective conductor to the connector member.

6. The electrical joint assembly of claim 1 wherein each of the limiter modules includes a visual indicator device configured to selectively indicate a status of the fuse element to an operator.

7. The electrical joint assembly of claim 6 wherein the visual indicator device includes a translucent or transparent viewing window.

8. The electrical joint assembly of claim 1 wherein each of the limiter modules includes:

an outer electrically insulating housing configured to receive at least one of the respective conductor leg and the respective conductor; and an inner housing defining a fuse chamber, wherein the fuse chamber is configured to contain the fuse element and failure byproducts of the fuse element to inhibit contamination of the at least one of the respective conductor leg and the respective conductor by the failure byproducts.

9. The electrical joint assembly of claim 1 wherein each of the limiter modules includes:

an electrically insulating housing configured to receive the respective conductor leg and the respective conductor;

first and second electrically conductive connector members disposed in the housing, wherein the first connector member is configured to engage and form an electrical connection with the respective conductor leg, the second connector member is configured to engage and form an electrical connection with the respective conductor, and the fuse element electrically connects the first connector member to the second connector member; and an electrically insulating bridge member interposed between the first and second connector members to maintain the first and second connector members in spaced apart relation.

10. The electrical joint assembly of claim 9 wherein each of the limiter modules further includes:

a first cable port including a first conductor passage configured to receive the respective conductor leg;

a first cable sealant disposed in the first conductor passage, the first cable sealant being adapted for insertion of the respective conductor leg therethrough for engagement with the first connector member such that the first cable sealant provides an environmental seal about the inserted respective conductor leg;

a second cable port including a second conductor passage configured to receive the respective conductor;

a second cable sealant disposed in the second conductor passage, the second cable sealant being adapted for insertion of the respective conductor therethrough for engagement with the second connector member such that the second cable sealant provides an environmental seal about the inserted respective conductor;

a first connector bolt to secure the respective conductor leg to the first connector member;

a second connector bolt to secure the respective conductor to the second connector member;

at least one access port defined in the housing to provide access to the first and second connector bolts; and an access sealant to environmentally seal the at least one access port.

11. The electrical joint assembly of claim 1 wherein each of the limiter modules is configured to receive and maintain the respective conductor leg and the respective conductor along substantially the same axis.

12. The electrical joint assembly of claim 1 wherein each of the limiter modules is water submersible in accordance with ANSI C119.1 Rev. dated Jan. 13, 2006.

13. The electrical joint assembly of claim 1 wherein the conductor legs are flexible.

14. The electrical joint assembly of claim 1 wherein the conductor legs are rigid.

15. The electrical joint assembly of claim 1 wherein each fuse element is adapted to protect secondary cables sized from about 1/0 to 1000 Kcmil.

16. The electrical joint assembly of claim 1 wherein each limiter module includes a key feature mateably engaging the fuse element, wherein the key feature is adapted to only mateably engage fuse elements having ratings in a prescribed range.

17. The electrical joint assembly of claim 1 wherein the busbar hub includes a cover surrounding and electrically insulating the busbar body, the cover including:

a cover portion formed of an electrically insulating first material; and an abrasion resistant outer layer formed of a second material having a greater abrasion resistance than the first material.

18. The electrical joint assembly of claim 1 wherein the busbar hub includes a cover surrounding and electrically insulating the busbar body, wherein the cover includes an abrasion resistant outer layer formed of ultra high molecular weight polyethylene (UHMWPE) and/or polyurethane.

19. The electrical joint assembly of claim 1 wherein the busbar hub includes a dielectric cover surrounding and electrically insulating the busbar body, and a mounting bracket integral with the cover.

20. The electrical joint assembly of claim 1 wherein at least one of the conductor legs is pre-bent into a non-linear configuration.

21. A limiter module for electrically connecting at least one conductor, the limiter module comprising:

a housing defining a port including a conductor passage configured to receive a conductor therethrough;

a fuse element disposed in the housing and connectable to the conductor inserted through the conductor passage; and sealant disposed in the conductor passage of the port, the sealant being adapted for insertion of the conductor therethrough such that the sealant provides an environmental seal about the conductor.

22. The limiter module of claim 21 further including:

an electrically conductive connector member disposed in the housing; and at least one shear bolt to controllably secure the conductor to the connector member.

23. A connector assembly for electrically connecting a plurality of conductors, the connector assembly comprising:

a housing defining a port including a conductor passage configured to receive a conductor therethrough;

sealant disposed in the conductor passage of the port, the sealant being adapted for insertion of the conductor therethrough such that the sealant provides an environmental seal about the conductor;

an electrically conductive connector member disposed in the housing; and at least one shear bolt to controllably secure the conductor to the connector member.

24. The electrical joint assembly of claim 1 wherein the conductor legs are each covered by a respective conductor insulation cover.

25. The electrical joint assembly of claim 1 wherein each of the limiter modules further includes:

an electrically insulating housing configured to receive the respective conductor leg and the respective conductor;

first and second electrically conductive connector members disposed in the housing, wherein the first connector member is configured to engage and form an electrical connection with the respective conductor leg, the second connector member is configured to engage and form an electrical connection with the respective conductor, and the fuse element electrically connects the first connector member to the second connector member;

a first cable port including a first conductor passage configured to receive the respective conductor leg;

a second cable port including a second conductor passage configured to receive the respective conductor;

a first connector bolt to secure the respective conductor leg to the first connector member; and a second connector bolt to secure the respective conductor to the second connector member.

26. The electrical joint assembly of claim 1 wherein the busbar hub includes elongate conductor legs extending lengthwise from opposed sides of the busbar body.

27. The electrical joint assembly of claim 26 wherein each pair of said opposed conductor legs is a segment of an integral conductor extending through the busbar body.

28. The connector assembly of claim 23 further including a fuse element, wherein the electrically conductive connector member is configured to engage and form an electrical connection with the conductor to electrically couple the conductor with the fuse element.

* * * * *